US005927906A

United States Patent [19]

Bach et al.

[11] Patent Number: 5,927,906

[45] Date of Patent: Jul. 27, 1999

[54] FASTENER ARRANGEMENT AND METHOD FOR SECURING CELLULAR CONFINEMENT SYSTEM

[75] Inventors: Gary Bach, Appleton; James Buchman, Hortonville; Daniel F. Senf, Appleton, all of Wis.

[73] Assignee: Reynolds Consumer Products, Inc., Appleton, Wis.

[21] Appl. No.: 08/799,619

[22] Filed: Feb. 12, 1997

[51] Int. Cl.[6] ..... E02D 17/20

[52] U.S. Cl. ..... 405/258; 405/15

[58] Field of Search ..... 405/258, 15, 16, 405/17; 24/129, 130

[56] References Cited

U.S. PATENT DOCUMENTS

| | | | |
|---|---|---|---|
| 294,240 | 2/1884 | Judd | 47/46 |
| 1,455,636 | 5/1923 | McConnal | 24/130 |
| 1,774,867 | 9/1930 | Booth . | |
| 2,809,067 | 10/1957 | Macchi | 294/50.7 |
| 3,897,712 | 8/1975 | Black | 85/9 |
| 3,934,802 | 1/1976 | Jennings | 248/71 |
| 4,202,378 | 5/1980 | Bush et al. | 138/96 R |
| 4,832,557 | 5/1989 | Jacobsen | 411/485 |
| 4,904,121 | 2/1990 | Hallberg | 405/16 |
| 5,037,688 | 8/1991 | Uchida | 405/258 |
| 5,252,016 | 10/1993 | Schmid et al. | 411/386 |
| 5,336,544 | 8/1994 | Bach et al. | 405/258 |
| 5,449,543 | 9/1995 | Bach et al. | 428/117 |

FOREIGN PATENT DOCUMENTS

| | | | |
|---|---|---|---|
| 2703377 | 10/1994 | France | 405/258 |
| 3816271 | 12/1988 | Germany | 405/258 |
| 304829 | 12/1988 | Japan | 405/258 |
| 1715983 | 2/1992 | U.S.S.R. | 405/16 |

*Primary Examiner*—Tamara Graysay
*Assistant Examiner*—Frederick L. Lagman
*Attorney, Agent, or Firm*—Alan M. Biddison

[57] ABSTRACT

A fastener for a cellular confinement system provides a tendon-retaining protrusion for receiving and retaining a reinforcing tendon passing through the cellular walls of the cellular confinement system or over the tops of the cellular walls of the cellular confinement system. The fastener includes a body with an opening configured to be attached to the end of a reinforcing bar for securing the tendon to the ground. Alternatively, the fastener is secured to the tendon so as to transfer forces from the cell wall of the cellular confinement system to the tendon.

54 Claims, 12 Drawing Sheets

FASTENER ARRANGEMENT AND METHOD FOR SECURING CELLULAR CONFINEMENT SYSTEM

FIELD OF THE INVENTION

The present invention relates to the practice of securing a cellular confinement system. More particularly, the invention relates to a fastener arrangement for securing to a reinforced cellular confinement system.

BACKGROUND OF THE INVENTION

Cellular confinement systems have been used on an increasing basis to resolve difficult engineering problems by enhancing the load bearing capacity, stability, and erosion resistance of materials which are placed within the cells of the systems. Uses of confinement systems have included, for example, supports for structural foundations, road bases, subgrades, and pavement systems. Additionally, cellular confinement systems have been stacked to provide earth and liquid retention structures, such as a stepped back design for hill slope retention. The light weight of, and ability to quickly install, cellular confinement systems have permitted them to be installed in difficult or remote locations where prior building-support techniques would be too expensive or too time consuming.

Cellular confinement systems also protect earth slopes, channels, and hydraulic structures from surface erosion. Grass and other earth slope cover materials have been protected and stabilized through the use of cellular confinement systems. Cells can be infilled with sand, rounded rock, granular soils, aggregates, topsoil, vegetative materials, and other earth materials. Concrete and soil-cement or asphaltic-cement can also be used to infill the cells.

A commercially available cellular confinement system is sold by Presto Products Company (Appleton, Wisconsin) in the form of a plastic-web soil confinement system which is made from high-density polyethylene strips joined by ultrasonic seams. The polyethylene strips are joined in a side-by-side relationship at alternating spacings so that the resulting web section has a honeycomb-like appearance with sinusoidal or undulant shaped cells when the strips are stretched out in a direction perpendicular to the faces of the strips. The sections are lightweight and shipped in their collapsed form for ease in handling and installation.

One challenge associated with the use of cellular confinement systems is that the fill material and the webs may be displaced during installation and long-term operation. Erosion below the web material may cause concrete infill to drop out of the cells. Applied forces such as hydraulic uplift and ice action may lift the web material or lift the fill material out of the cells. Translational movement of the webs may also occur in channel lining applications, or when installing on steep slopes.

In an effort to overcome these problems, "J-hooks", sometimes made from bent steel reinforcement rod or steel rod, have been intermittently spaced along the face of some cell walls and driven into the ground to anchor the web materials before the cells are infilled. The rounded portions of the J-hooks extend over the tops of the cell walls to limit displacement of the web material. While this approach limits displacement of the web materials in some applications, it has not been completely successful in preventing movement of the webs and can leave a portion of the J-hooks extending above the web material.

Another approach involves the use of reinforcing members positioned within a hole in the web material, as indicated in U.S. Pat. No. 5,449,543 to Bach et al. While this approach has shown success at preventing such movement, securing the reinforcing members to the web and to the ground has posed a problem. With the reinforcing member implemented as a flexible tendon, the tendon is usually secured to the web by a knot, a washer, or a loop around a segment of PVC pipe. The tendon is often also secured to a segment of steel reinforcing bar driven into the ground. To secure a tendon to the reinforcing bar, the bar is typically bent on the top end to create a hook. The task of bending the hook into the reinforcing rod can be both time consuming and expensive. Further, forming the hook sometimes requires heating the end of the reinforcement rod before attempting to bend it. For certain applications, this task must be done at the job site, and it can be difficult to find contractors capable of performing the work.

The use of bent reinforcing rods can also result in utilization of a larger quantity of reinforcing rod than is desirable. The entire hook is made out of reinforcing rod, and therefore roughly six inches of rod is often used to create the hook. This six inch portion of rod requires an additional expense.

Other problems associated with using bent reinforcing rods is that they typically have a small "striking surface" for driving the rod into the ground and the striking surface may not be perfectly centered above the shaft of the rod, resulting in the rod shaft bending when the shaft hits an obstruction, such as a rock. The off-center striking surface also makes driving the rod straight down more difficult.

Consequently, a need exists for a fastener for a cellular confinement system which overcomes the aforementioned shortcomings associated with existing fasteners.

SUMMARY OF THE INVENTION

The present invention is directed to a fastener for use with a three-dimensional cellular confinement system. The cellular confinement system typically has a multitude of cells defined by cellular walls. The fastener comprises a body with a first portion having an opening arranged to receive a reinforcing bar, and a second portion configured to receive an external force of sufficient magnitude to securely hold the reinforcing bar in the opening of the first portion. In one particular implementation of the present invention, the opening in the first portion is tapered such that the opening narrows as it progresses into the body of the fastener.

In a more particular implementation of the present invention, the fastener includes a tendon-retaining protrusion extending from and integrally formed with the body. This tendon-retaining protrusion receives and retains a tendon passed through the cellular walls and secures the cellular confinement system. The second portion may include a drive surface to receive an external force of sufficient magnitude to friction-fit and lock the reinforcing bar into the opening.

In another particular implementation, the fastener includes two tendon-retaining protrusions. The protrusions extend from and are integrally formed with the body for receiving and retaining the tendon. These tendon-retaining protrusions are positioned substantially opposite one another, and are formed such that they secure a tendon when a tensile force is applied to the tendon.

In certain other implementations, the body includes a surface conforming to the shape of a cell wall of the cellular confinement system. For example, in one embodiment the body includes a convex surface conformable to a concave cell wall, and a concave surface conformable to a convex cell wall. The fastener is formed of any one of numerous molded materials. The material is, for example, polyethylene.

In yet another implementation of the invention, the body is integrally molded to a reinforcing bar so that the bar is fixed adjacent to the end of the reinforcing bar. The top portion is configured and arranged to receive an external force of sufficient magnitude to drive the reinforcing bar into the substrate. A tendon-retaining protrusion, extending from and integrally formed with the body for receiving and retaining a tendon securing the cellular walls, passes through the cellular walls and secures the cellular confinement system.

The tendon-retaining protrusion comprises an arm integrally molded to the body and positioned proximate the body such that a portion of a tendon is retained in a space defined between the body and the arm. A portion of the arm distal from the shoulder may include an extension projecting toward the body to further retain the tendon between the arm and the body. In some implementations, the extension includes an outer surface inclined toward the space between the body and the arm to facilitate insertion of the tendon. In other implementations, a portion of the arm distal from the shoulder is tapered away from the space to facilitate insertion of the tendon.

The above summary of the invention is not intended to describe each illustrated of the present invention. This is the purpose of the figures and the Detailed Description section which follow.

BRIEF DESCRIPTION OF THE DRAWINGS

Other aspects and advantages of the invention will become apparent upon reading the following Detailed Description and upon reference to the drawings as described below.

While the invention is susceptible to various modifications and alternative forms, specifics thereof have been shown by way of example and the drawings, and will be described in detail. It should be understood, however, that the intention is not to limit the invention to particular embodiments described. On the contrary, the intention is to cover modifications, equivalents, and alternatives falling within the spirit and scope of the invention as defined by the appended claims.

DESCRIPTION OF THE ILLUSTRATED EMBODIMENTS

Figure 6:
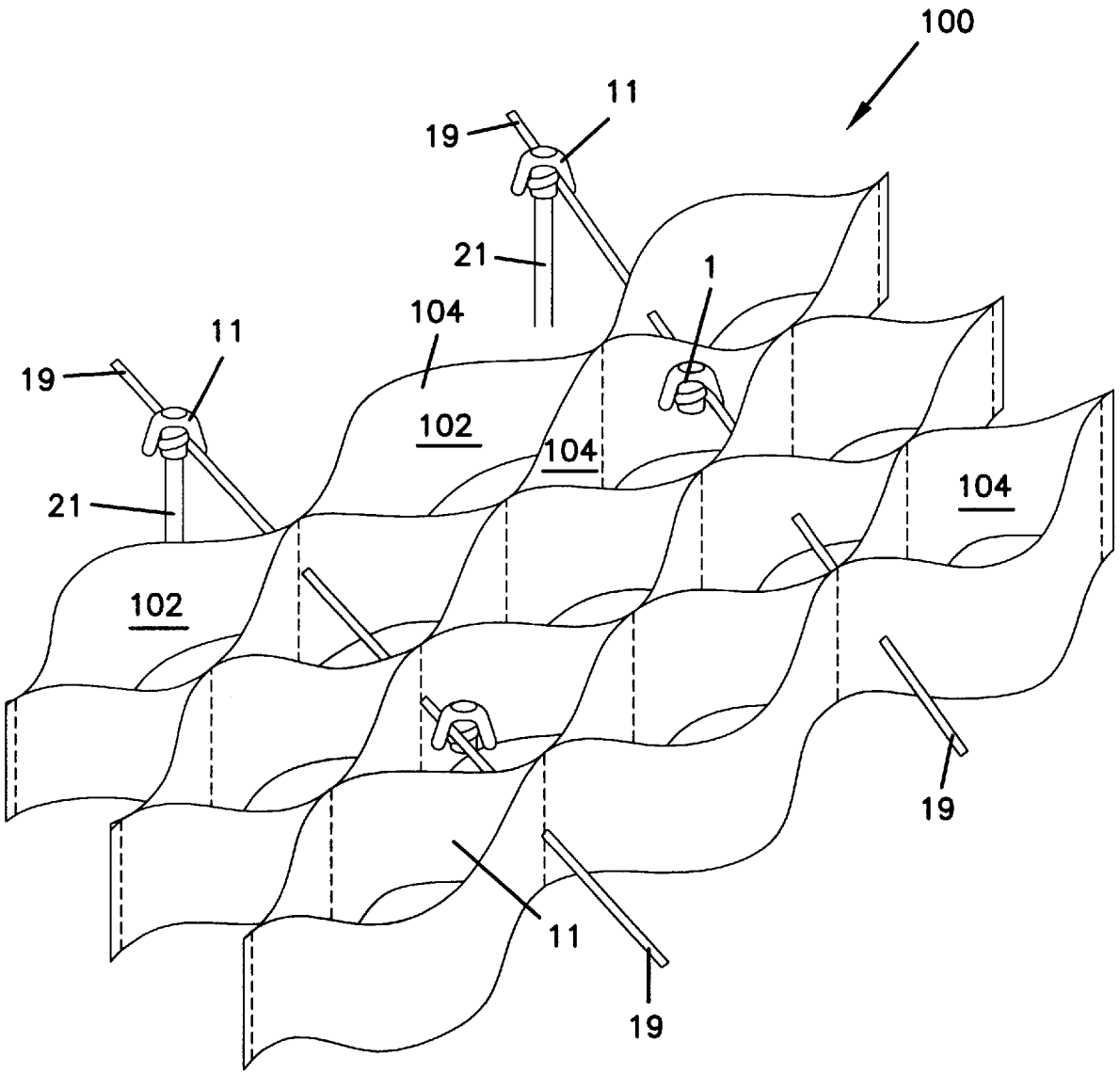
FIG. 6 is an elevated perspective view of a plurality of fasteners installed in a cellular confinement system in accordance with the present invention.
Figure 7:
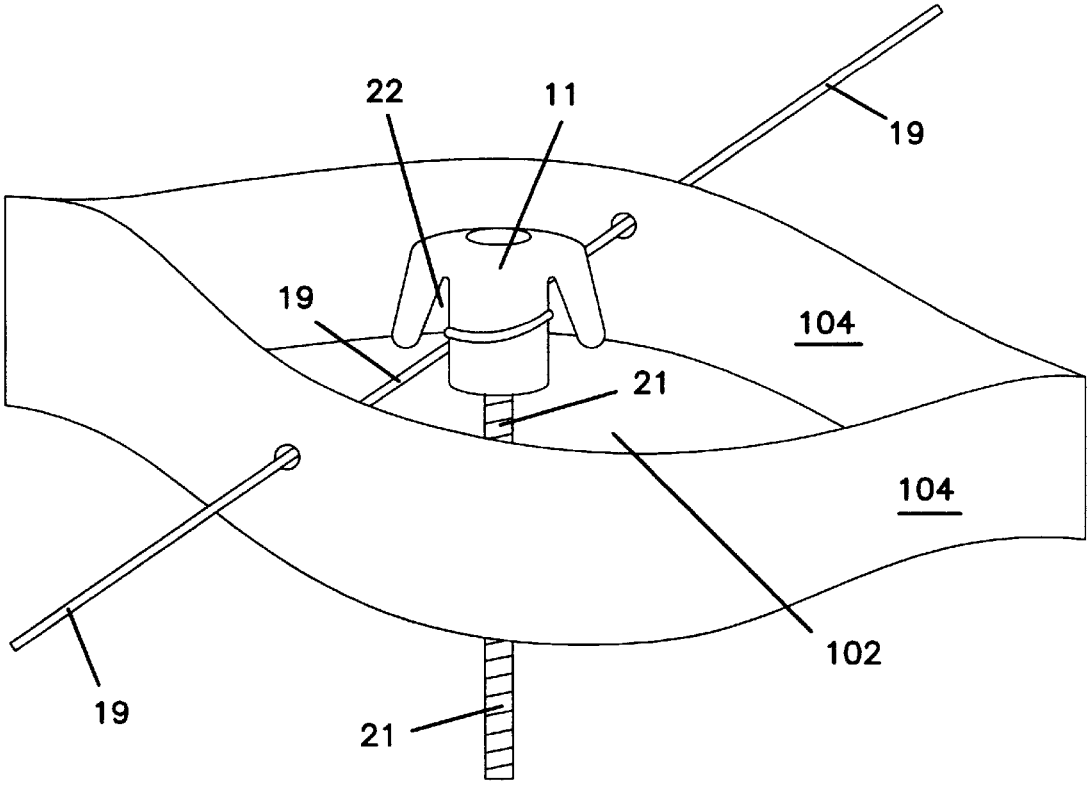
FIG. 7 is an elevated perspective view of a fastener for a cellular confinement system in accordance with the present invention showing the fastener tying down a tendon within a cell of the cellular confinement system.
Figure 8:
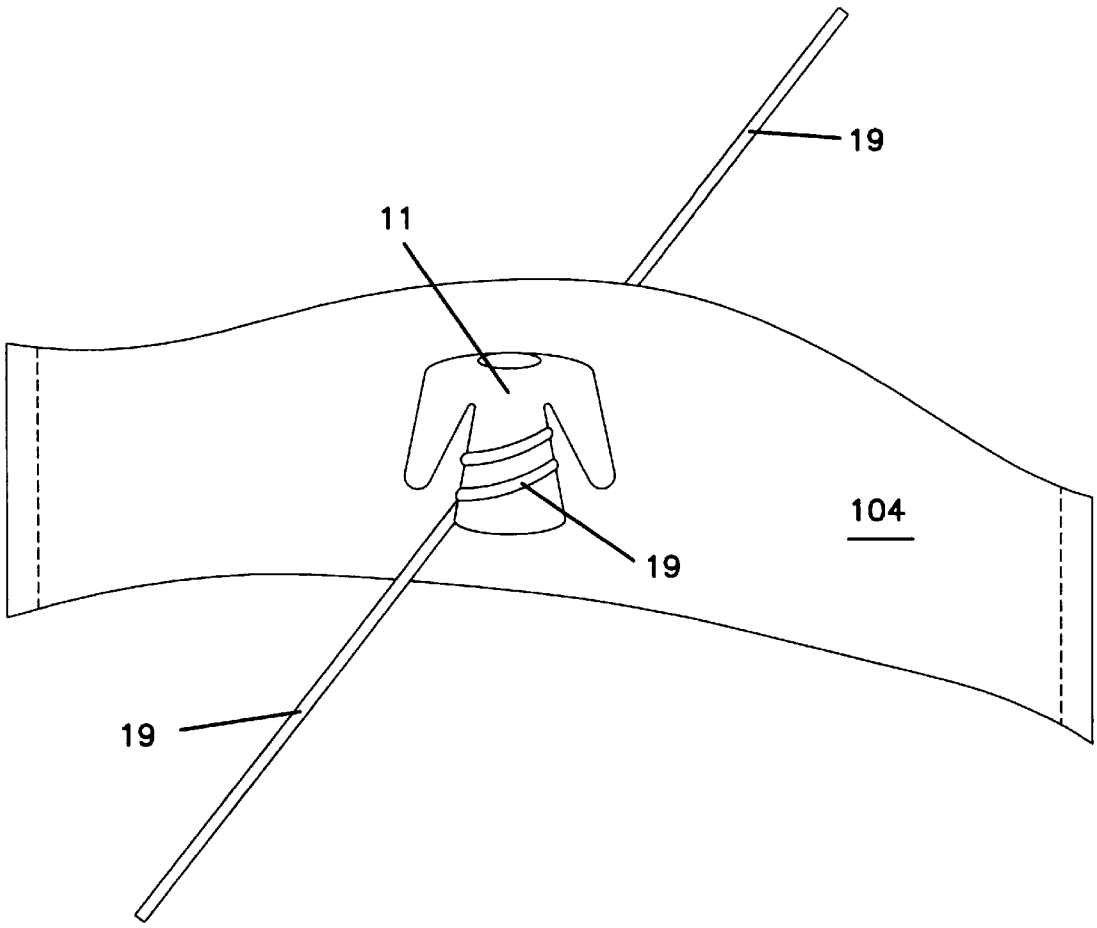
FIG. 8 is an elevated perspective view of the fastener for a cellular confinement system in accordance with the present invention showing the fastener retaining a tendon within a cell of the cellular confinement system.

A fastener for a cellular confinement system, constructed in accordance with the present invention, is shown generally as 11 in FIGS. 1 through 5. Fastener 11 has a body 12 having a top 13 and a bottom 14. The top 13 includes a shoulder 16 from which a tendon-retaining protrusion 17 extends. The tendon-retaining protrusion 17 retains a tendon 19 between the tendon-retaining protrusion 17 and body 12 of the fastener 11, as shown in FIGS. 6 through 8. In one implementation, the tendon-retaining protrusion 17 is an arm 18. The gap 22 between the arm 18 and body 12 retains a tendon 19 and prevents the tendon 19 from sliding with respect to the fastener 11.

The fastener 11 includes an opening 20 at the bottom 14 of the body 12. Opening 20 is arranged to receive a reinforcing rod 21. The reinforcing rod 21 is constructed of a material sufficiently strong to withstand being driven into the ground by a hammer, maul, piston or other implement for delivering an external force. In addition, the reinforcing rod 21 is able to withstand a translational force once driven into the ground. The reinforcing rod 21 may be formed of any one of numerous materials, including coated or uncoated steel reinforcing rod (also known as "rebar"), or smooth steel rod.

The top 13 of the body 12 includes a drive surface 26 configured and arranged to receive an external force of sufficient magnitude to securely hold the reinforcing rod 21 in the opening 20 of the body 12. The drive surface 26 is wide enough and strong enough to receive a blow from a hammer, mallet, maul, or other implement used to apply an external force.

Figure 4:
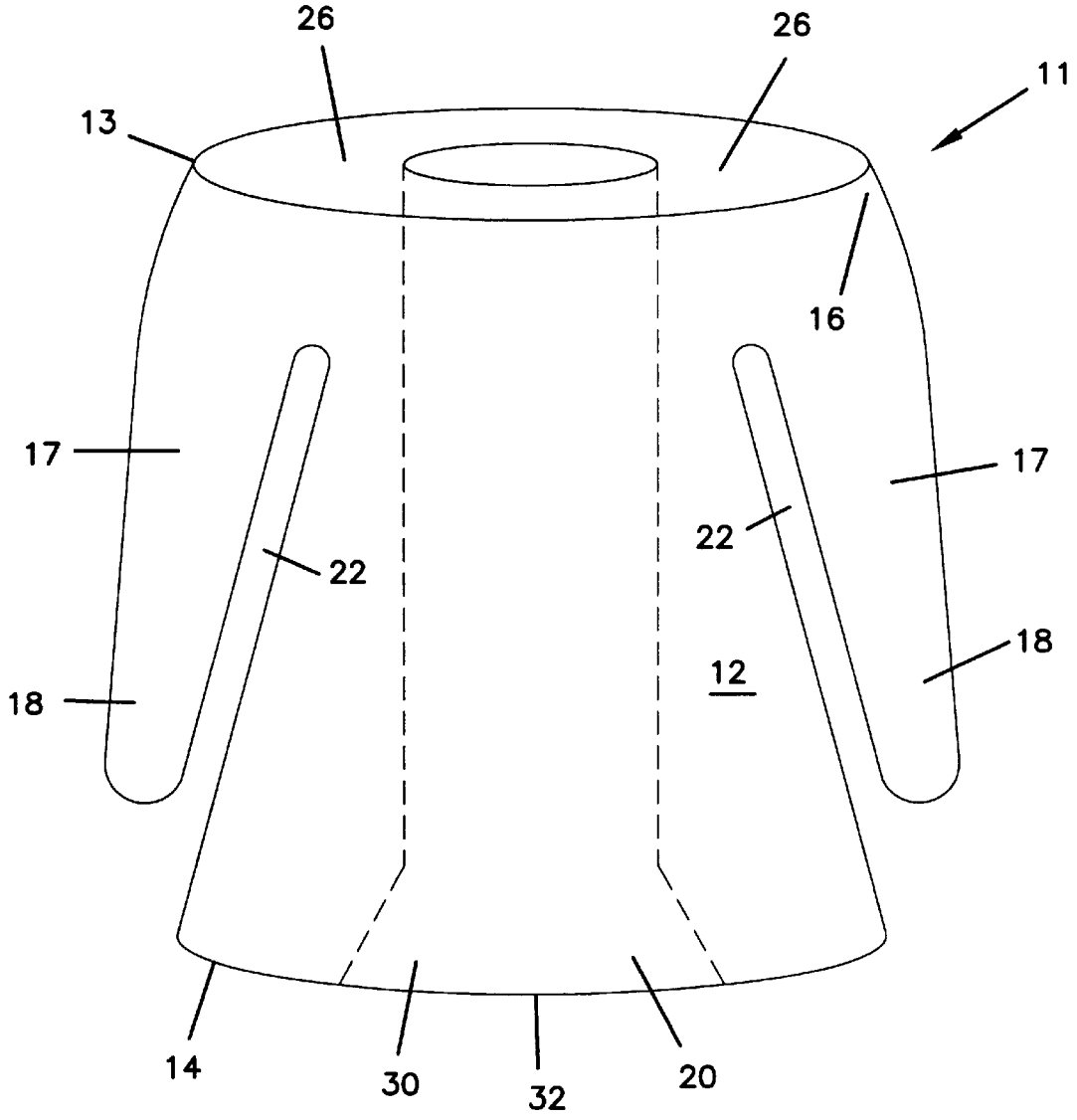
FIG. 4 is a front elevational view of a fastener for a cellular confinement system in accordance with the present invention, showing a tapered opening in phantom lines.

In one implementation, shown in FIG. 4, the opening 20 is tapered such that it narrows as it progresses into the body 12. This taper provides an increased hold between the fastener 11 and reinforcing rod 21. The taper should be great enough that the opening 20 in the fastener 11 provides a firm grip on the end of the reinforcing rod 21. However, the taper must not be so great that the internal stresses on the fastener 11 cause it to weaken and potentially fail. It has been found that degrees of taper which satisfy these conditions include about 1–5 degrees, and more specifically about 2–3 degrees. The rod 21 may have raised areas 23 which assist in securing the fastener 11 to the rod 21. These raised areas 23 create "upset" material on the walls of the tapered opening 20, and assist in retaining the fastener 11 to the rod 21.

In most applications, the fastener 11 is constructed of a material which is readily molded, able to withstand extremes in temperature, corrosion resistant and durable. In one implementation, the fastener 11 is molded of a thermoplastic substance. In a specific implementation, the fastener 11 is molded of polyethylene, which is the most prevalent material used to make cellular confinement systems and has resistance to corrosion from acidic and alkaline substances.

In a particular application of the present invention, the tendon-retaining protrusion 17 includes two arms 18 extending downward from the shoulder 16 of the fastener 11. However, other arrangements of the tendon-retaining protrusion 17 are also acceptable. For example, specific implementations include only one arm 18 extending from the shoulder 16, a first arm extending from the top portion of the body 12 and a second arm extending from the bottom portion of the body 12, and more than two arms. A single arm may retain more than one tendon 19, and a fastener with more than one arm may retain one tendon 19 under each arm 18.

Figure 1:
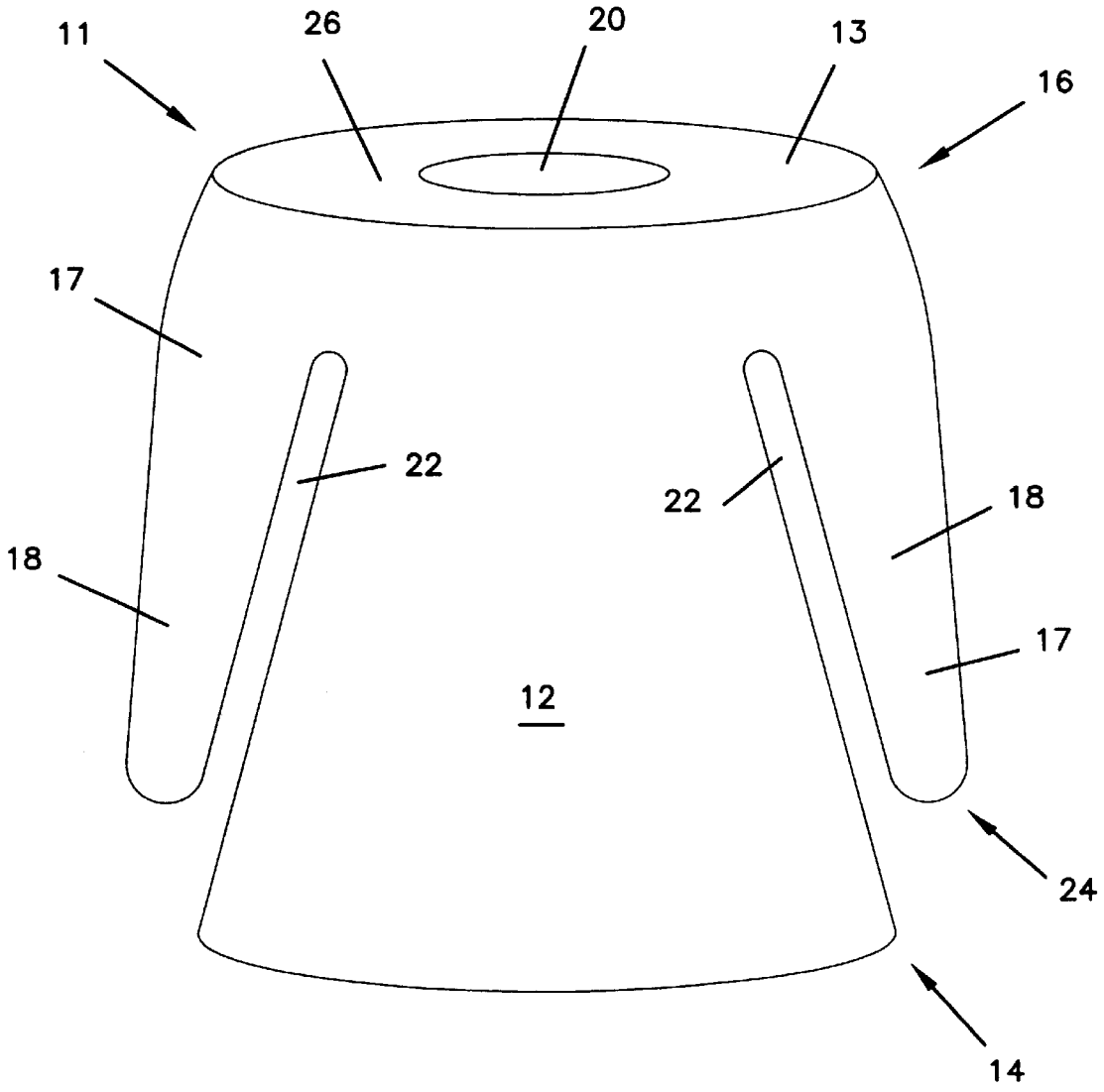
FIG. 1 is a front elevational view of a fastener for a cellular confinement system in accordance with the present invention.
Figure 2:
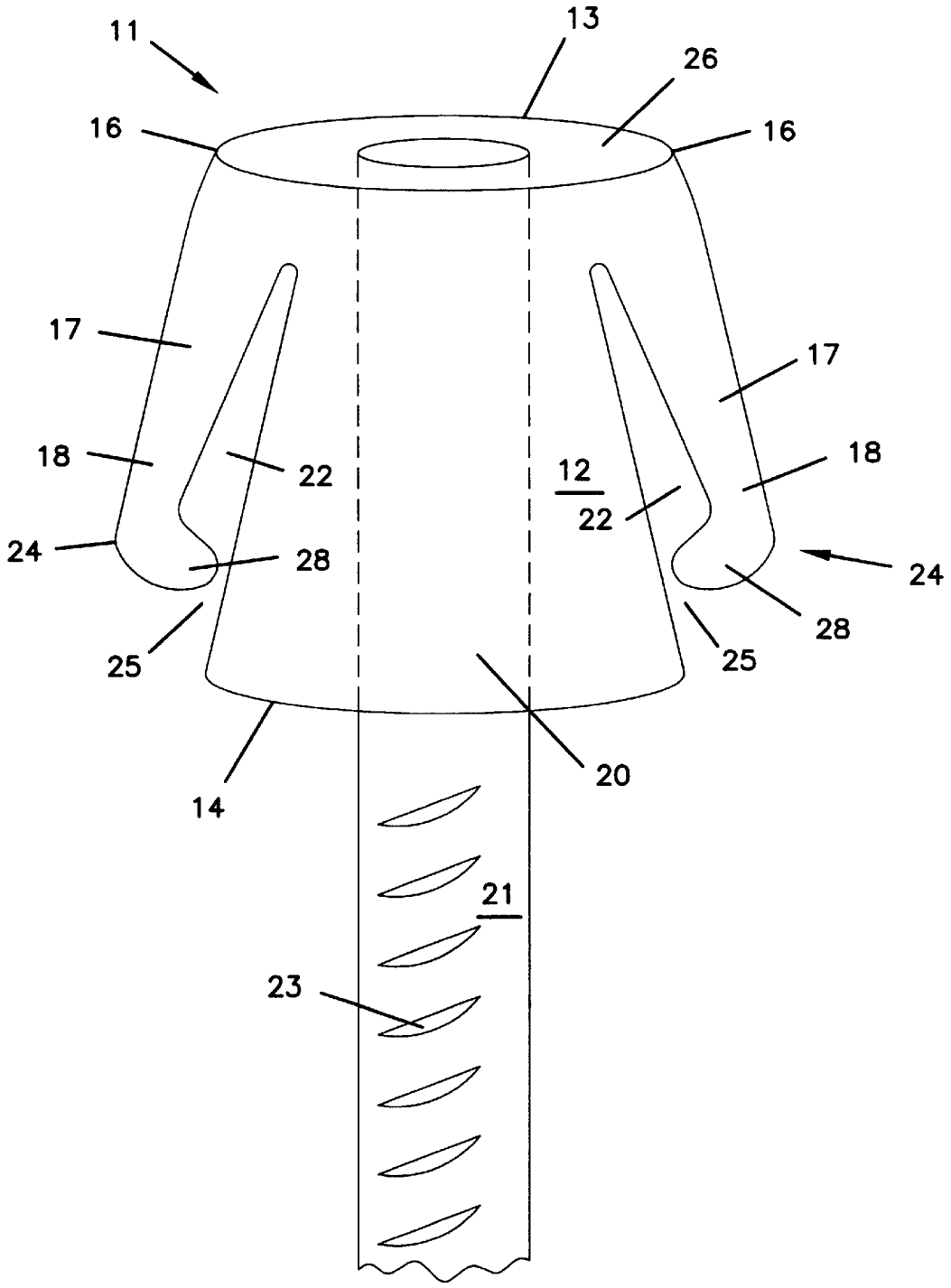
FIG. 2 is a front elevational view of a fastener for a cellular confinement system in accordance with the present invention, showing the fastener driven onto a reinforcing bar.

The arms 18 are configured to provide a secure grip on the tendon 19. The gap 22 between the arm 18 and body 12 is formed of a size so that the tendon 19 is securely held between the body 12 and the arm 18. The arm 18 may further include a knob or extension 28 to lock the tendon 19 in place in the gap 22, as shown in FIG. 2. The extension 28 is positioned at the distal end 24 of the arm 18 to narrow the gap 22 between the arm 18 and body 12. The reduced span 25 formed between the extension 28 and body 12 is narrower than the width of the tendon 19. The arm 18 has sufficient flexibility to flex and permit the tendon 19 to pass through the reduced span 25 and into the gap 22. This feature is particularly useful in retaining a tendon 19 during cold weather when the tendon 19 is stiff and difficult to tie into a knot.

Figure 3A:
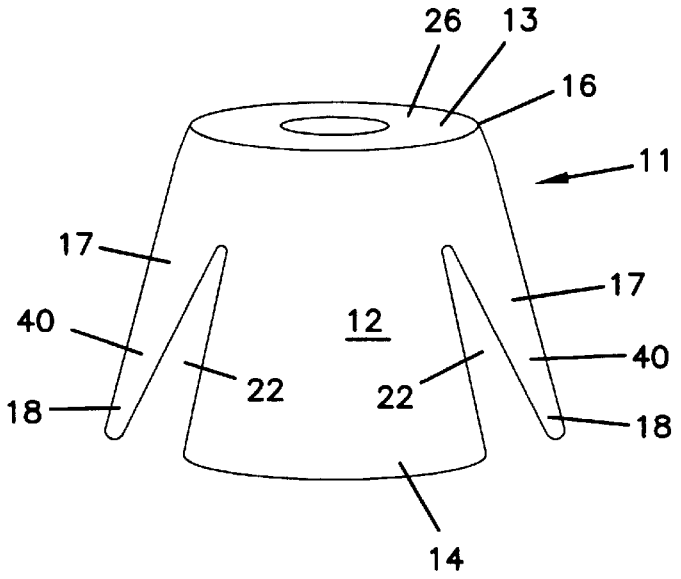
FIG. 3A is a front elevational view of a fastener for a cellular confinement system in accordance with the present invention, showing tapered arms on the fastener.
Figure 3B:
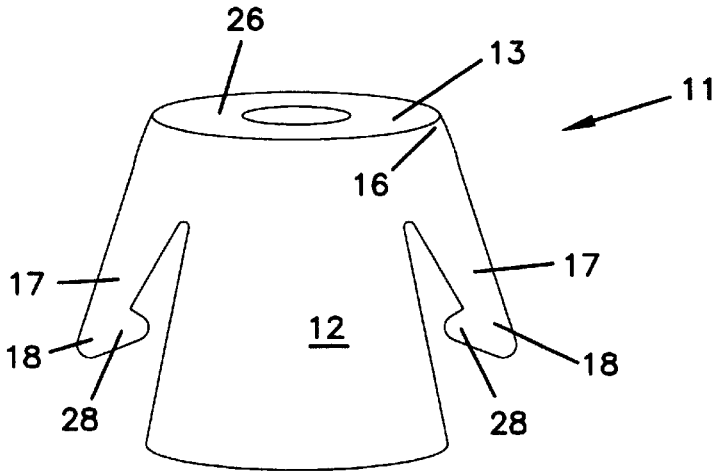
FIG. 3B is a front elevational view of a fastener for a cellular confinement system in accordance with the present invention, showing arms with tapered extensions for facilitating the insertion of a tendon.
Figure 3C:
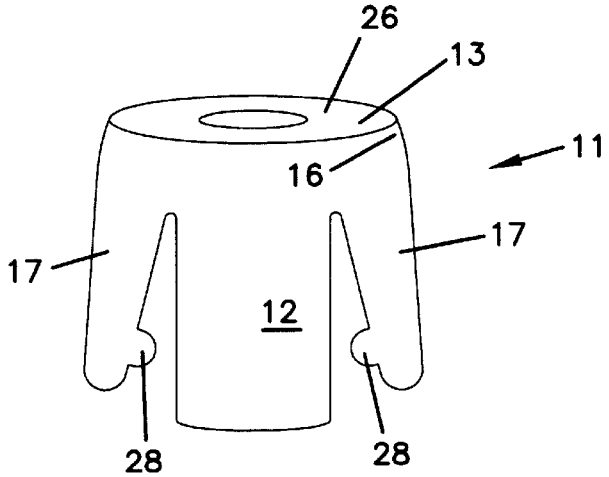
FIG. 3C is a front elevational view of a fastener for a cellular confinement system in accordance with the present invention, showing arms with extensions at an intermediate position on the arms.

Referring now to FIG. 3A, a front elevational view is shown of a fastener 11 having tapered arms 18. A tapered portion 40 permits a tendon 19 to more easily be inserted into the space or gap 22 between the arm 18 and the body 12. FIG. 3B depicts arms with tapered extensions 28 for facilitating the insertion of a tendon 19, while locking the tendon in place in the gap 22 after insertion past the extension 28. FIG. 3C shows an extension 28 at an intermediate position of the arms between the shoulder 16 and distal end 24.

In one implementation, shown in FIG. 4, the opening 20 includes a first section 30 near the base 32 of the opening 20 which has an increased diameter to facilitate alignment with the rod 21 when driving the fastener 11 onto the rod 21. This increased diameter directs the rod 21 into the opening 20 when the fastener is positioned on the end of rod 21 prior to being driven onto the rod 21. Also, this increased diameter of the first section 30 of the opening 20 provides a means to temporarily retain the fastener 11 on top of the rod 21 prior to driving it permanently onto the rod 21.

Figure 5:
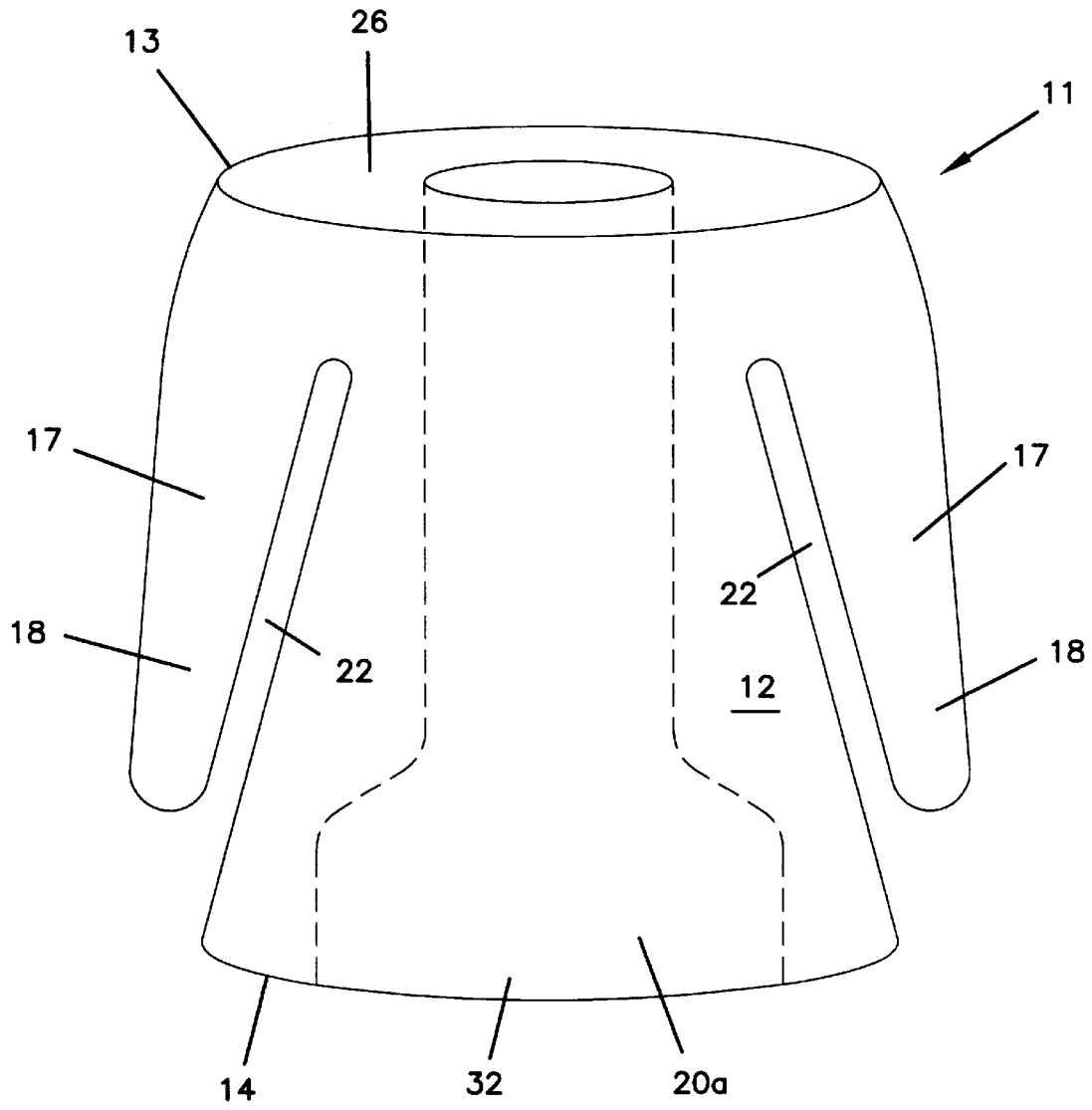
FIG. 5 is a front elevational view of a fastener for a cellular confinement system in accordance with the present invention, showing a counterbore in phantom lines.

Referring now to FIG. 5, the formation of the opening 20 may include a counterbore 20*a* facilitating the insertion of the fastener 11 onto the reinforcing rod 21. Counterbore 20*a* has a diameter greater than reinforcing rod 21, yet narrow enough to provide some contact with the end of reinforcing rod 21 and help hold the fastener 11 onto the reinforcing rod 21 prior to driving the fastener 11 onto the rod 21. Counterbore 20*a* is particularly useful when installing fasteners 11 onto uneven, rough, or jagged ends of reinforcing rods 21, since it helps in temporarily holding the fastener in place.

In certain implementations, the fastener 11 is constructed of various colors to signify their size and use. For example, in some applications, fastener 11 is constructed in a variety of sizes to accommodate reinforcing rods 21 having different widths, such as one-quarter inch, one-half inch, and one inch. Each size of fastener 11 is constructed of a different colored thermoplastic material so that the proper fastener 11 may quickly and accurately be identified during installation. Alternatively, in other applications, different colors of thermoplastic are used to represent different applications or different strengths of fastener 11. For example, a corrosion-resistant polyethylene fastener 11 can be manufactured of a different colored material than a non-corrosion resistant polyethylene fastener 11.

The fastener 11 may be secured to the reinforcing rod 21 by a number of different methods. In a first implementation, the reinforcing rod 21 is driven into the opening 20 at the cellular confinement system installation site, at an off-site facility such as a workshop, or at the fastener manufacturing facility. The fastener 11 is driven onto the reinforcing rod 21 with a manually driven tool such as a hammer, maul, or mallet. Alternatively, a hydraulic press or other mechanical means is used to drive the fastener 11 onto the reinforcing rod 21.

In another implementation, the fastener 11 is integrally molded onto the end of the rod 21. In this application, the end of the rod 21 projects into the mold while the fastener 11 is molded. In still another implementation, the rod 21 and fastener 11 are integrally molded as one composite piece so that the rod 21 is formed of the same material as the fastener.

Figure 9:
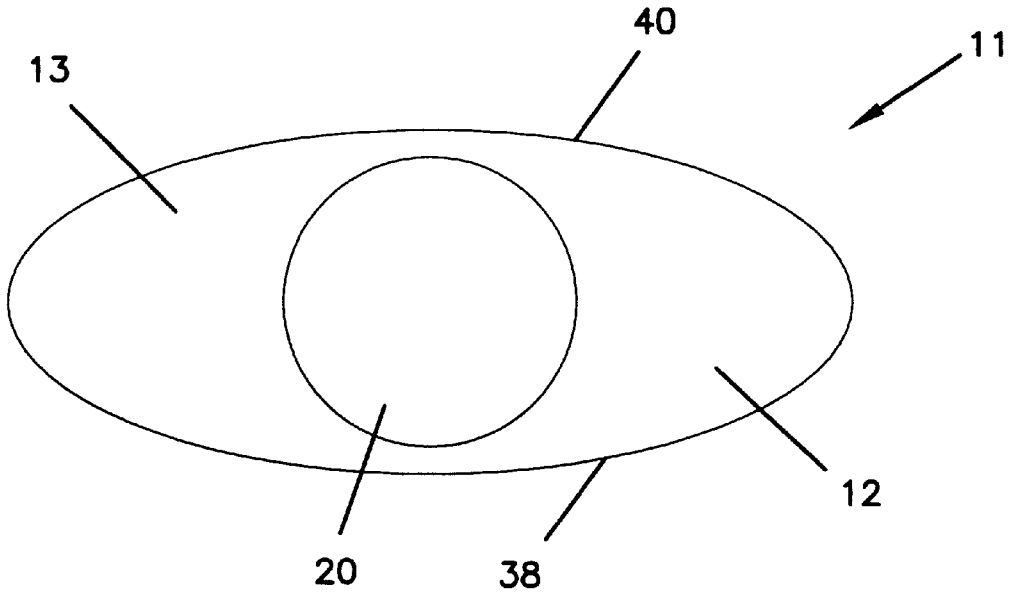
FIG. 9 is a top plan view of a fastener for a cellular confinement system in accordance with the present invention.
Figure 10:
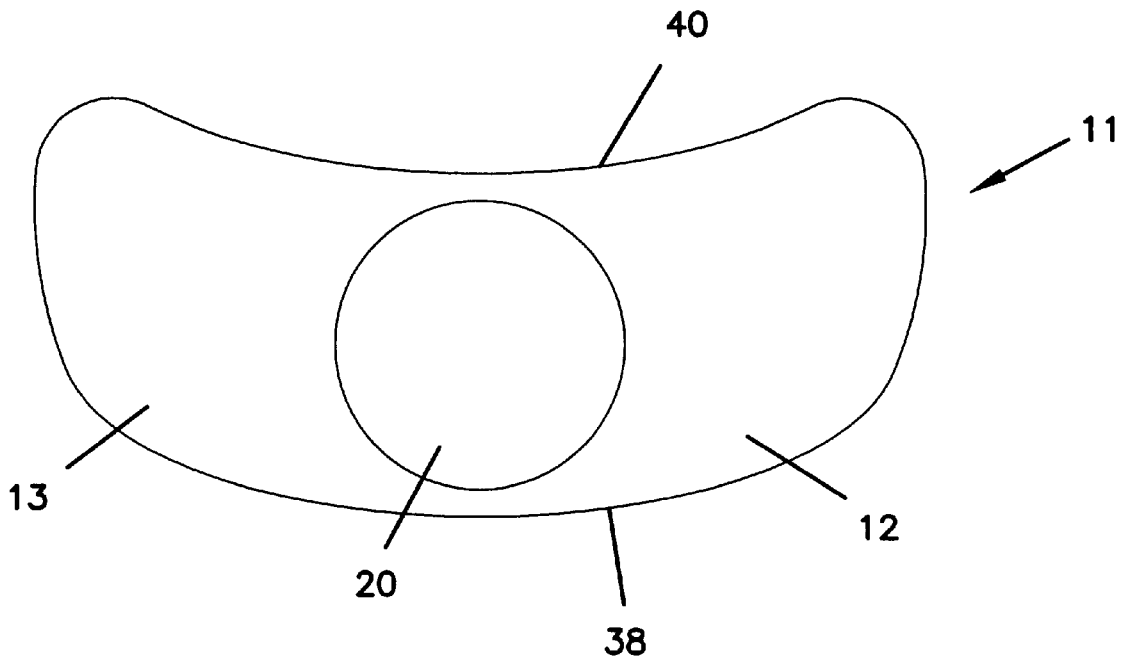
FIG. 10 is a top plan view of a fastener for a cellular confinement system in accordance with the present invention having curved front and back surfaces.

The fastener 11 has a front surface 38 and a back surface 40. In certain implementations, one or both of these surfaces are shaped so that they conform to the shape of the cell wall 104 of the cellular confinement system 100 shown in FIGS. 6 through 8. In some applications, the cellular walls 104 of the cellular confinement system 100 have a sinusoidal shape with alternating convex and concave surfaces. As shown in FIGS. 9 and 10, to conform to these sinusoidal surfaces, the front surface 38 and back surface 40 of the fastener 11 include either a concave surface, a convex surface, or a concave surface and a convex surface. If the cellular walls 104 have substantially flat or angled surfaces, the front and back surfaces 38, 40 of the fastener 11 may be configured to conform to these surfaces. By conforming to the cell walls 104, the body 12 distributes the retaining force from the tendon 19 to the cell wall 104 more evenly and avoids failure of the cell wall 104.

Figure 11:
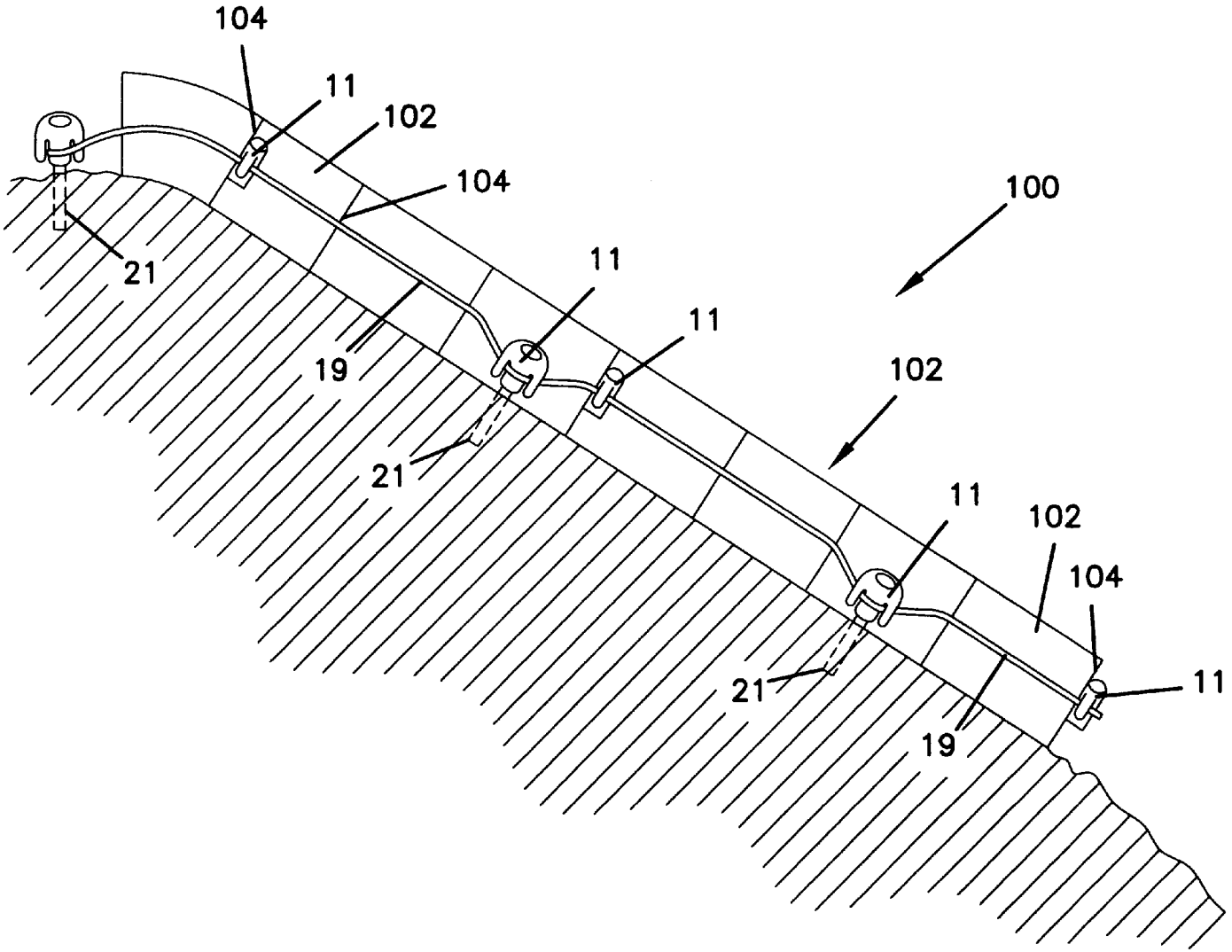
FIG. 11 is a side view of a cellular confinement system in accordance with the present invention showing fasteners securing the cellular confinement system on an incline.

As shown in FIG. 11, the fastener 11 can be used-both to tie a tendon 19 to the ground or to tie off the tendon 19 within a cell 102. The tendon may be either coated or uncoated, and may be formed of polyetheylene, polypropylene, steel, other synthetic or natural fiber. In many applications, the installed cellular confinement system 100 is subject to translational forces. For example, a cellular confinement system 100, installed at an incline along the sides of an irrigation canal will be subject to a translational force pulling the cellular confinement system 100 down the slope. This translational force is countered by securing a reinforcing tendon 19 within the cellular confinement system 100 and then securing the end of the reinforcing tendon 19 to a reinforcing rod 21 equipped with a fastener 11. In addition to securing the end of the tendon 19 to the reinforcing rod 21, intermediate positions on the tendon 19 can also be secured to a reinforcing rod 21 fitted with a fastener 11.

In some applications it is not possible to drive a reinforcing rod 21 into the ground beneath the cellular confinement system 100. For example, the above-discussed plastic cellular confinement system 100 is useful in protecting the polymer liners underlying waste treatment ponds. The system may be placed above the liner and then backfilled with a suitable fill material. The system and fill material protect the liner from damage through physical abrasion and also from solar radiation. However, the inclined sides of the pond make movement of the system downhill probable if the system is not retained. Also, the polymer liner in the pond is often very slick, and thus the system is even more prone to sliding from translational forces. Unfortunately, the reinforcing rods 21 cannot be driven into the ground to prevent translational movement because they would puncture the liner and possibly produce a leak. This leaking problem is averted by using a tendon 19 anchored to a position above the liner. The tendon 19 is preferably secured to the system at numerous cells. The tendon 19 is looped around the fastener 11 or otherwise attached to the fastener 11 so as to lock the tendon 19 in place. The fastener 11 is then drawn tight against the cell wall 104, thereby supporting the system and fill material from translational motion. Depending on the slope of the installation and the weight of the fill material, more or fewer fasteners 11 may be installed to transfer the translational force to the tendons 19 and anchors.

The tendon 19 is secured to the fastener 11 in a number of manners. In a first implementation, the tendon 19 is looped around the fastener 11 to secure it. The tendon 19 may be looped one or more times around the body 12. The fastener 11 distributes the force to the walls 104 of the cellular confinement system 100. In some applications, the surfaces 38, 40 of the body 12 of the fastener 11 are shaped to conform to the cell walls 104 of the cellular confinement system 100.

In one implementation, a plurality of tendons 19 are used to secure the cellular confinement system 100. Depending upon the needs of a specific site, the number of fasteners 11 may be varied, as may the way in which they are installed.

The tendons 19 used in conjunction with the fasteners 11 also facilitate resistance to applied forces such as hydraulic uplift and ice action which tend to lift the cells 102. To counter this action, in some implementations the cells 102 are anchored to the ground at spaced intervals along the tendons 19 to prevent lifting of the cellular confinement system 100. FIG. 9 demonstrates such a use. The fasteners 11 internally anchor the tendon 19 and the cellular confinement system 100 to minimize lifting of the cellular confinement system 100 away from the ground. The fasteners 11 are spaced at intervals along the entire length of the cellular confinement system 100 to resist forces along the entire expanse of the cellular confinement system 100.

Figure 12:
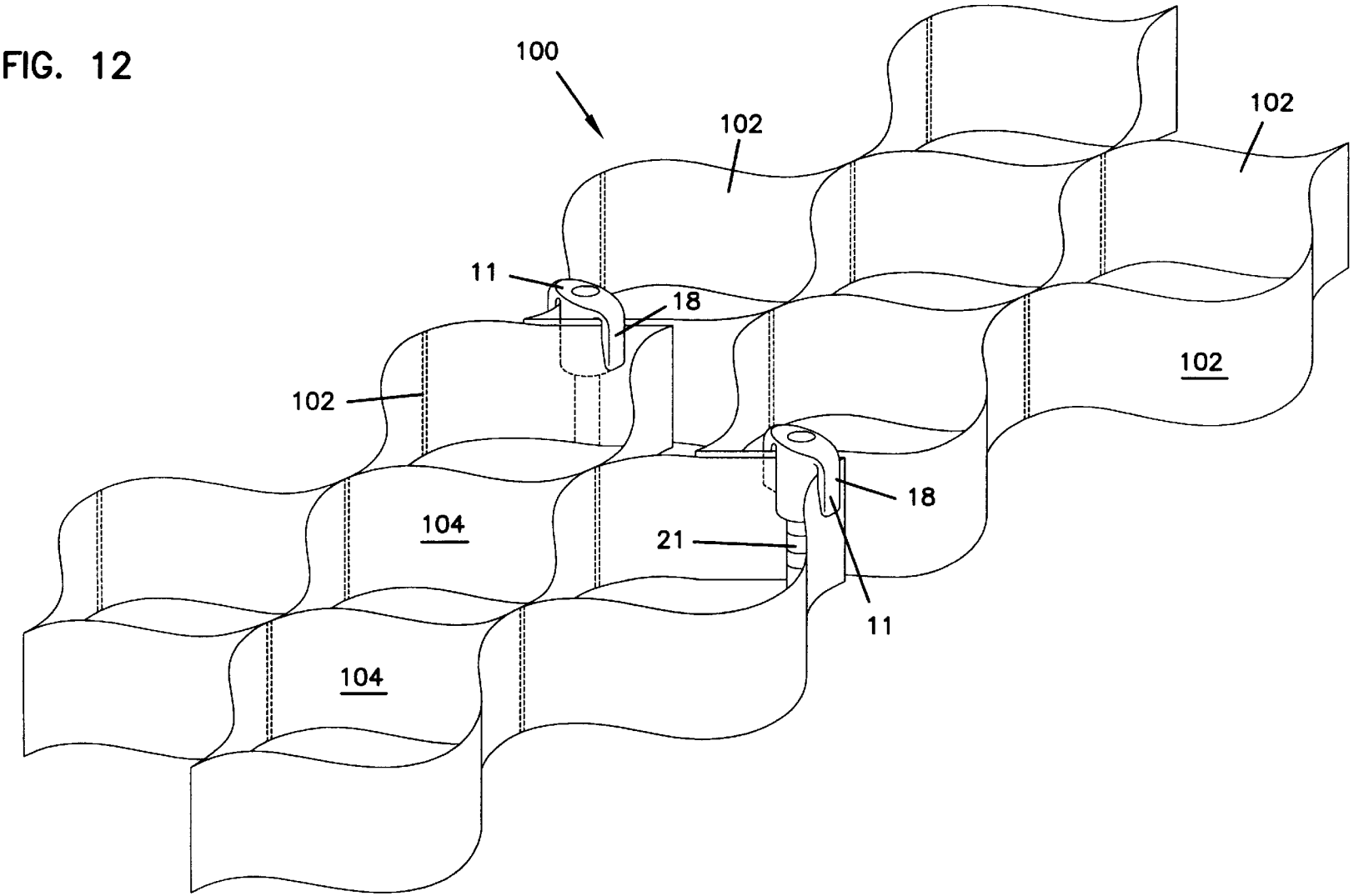
FIG. 12 is an elevated perspective view of a plurality of fasteners installed in a cellular confinement system in accordance with the present invention.

Referring now to FIG. 12, the fasteners 11 can also be used to retain the cellular confinement system 100 directly in place by securing the cellular wall 104 in the gap 22 between the arm 18 and body 12. The arm 18 is placed over the top edge of a cellular wall while the rod is driven into the ground. In this manner, the cellular wall and cellular confinement system are held securely in place, and longitudinal movement is restricted and uplifting is prevented. Also, two or more cellular walls may be secured to one fastener 11 in order to join separate groups of reinforcing cells. The fasteners may be installed such that they join the cell wall of one group of reinforcing cells to the cell walls of a second group of reinforcing cells, thereby permitted large surfaces of joined cells to be formed.

It will be apparent to those skilled in the art that various modifications and variations can be made to the embodiments illustrated herein without departing from the scope or spirit of the invention, as set forth by the following claims.

I claim:

1. For use with a three-dimensional cellular confinement system having a multitude of cells defined by cellular walls, a fastener comprising:

a body with a first portion and a second portion;

the first portion having an opening arranged to receive a reinforcing bar;

the second portion configured and arranged to receive an external force of sufficient magnitude to securely hold the reinforcing bar in the opening; and a tendon-retaining protrusion extending from and integrally formed with the body for receiving and retaining a tendon passing through the cellular walls and securing the cellular confinement system.

2. A fastener, according to claim 1, wherein the second portion includes a drive surface to receive the external force of sufficient magnitude to securely hold the reinforcing bar in the opening; and the opening extends from the first portion through the second portion.

3. A fastener, according to claim 1, wherein the fastener includes at least two tendon-retaining protrusions extending from, and integrally formed with, the body for receiving and retaining the tendon.

4. A fastener, according to claim 3, wherein the tendon-retaining protrusions are positioned substantially opposite one another.

5. A fastener, according to claim 1, wherein the tendon-retaining protrusion secures a tendon when a tensile force is applied to the tendon.

6. A fastener, according to claim 1, wherein the body includes a first surface conforming to a shape of a cell wall of the cellular confinement system.

7. A fastener, according to claim 1, wherein the body includes a convex surface conformable to a concave cell wall and a concave surface conformable to a convex cell wall.

8. A fastener, according to claim 1, wherein the opening in the first portion extends through the second portion.

9. A fastener, according to claim 1, wherein the opening in the first portion is tapered such that the opening narrows as it progresses into the body.

10. A fastener, according to claim 9, wherein the opening is tapered from 1 to 5 degrees.

11. A fastener, according to claim 9, wherein the opening is tapered from 2 to 3 degrees.

12. A fastener, according to claim 1, wherein the first portion includes a counterbore constructed and arranged to temporarily retain the fastener on the retaining bar.

13. A fastener, according to claim 1, wherein the fastener is formed of a molded thermoplastic material.

14. A fastener, according to claim 13, wherein the fastener is formed of polyethylene.

15. A fastener, according to claim 1, wherein the reinforcing bar is one of the following: a steel rebar and a smooth steel rod.

16. For use with a three-dimensional cellular confinement system having a multitude of cells defined by cellular walls, a fastener comprising:

a thermoplastic body integrally molded to a reinforcing bar so that the body is fixed adjacent to the end of the reinforcing bar;

a top portion configured and arranged to receive an external force of sufficient magnitude to drive the reinforcing bar into a substrate; and a tendon-retaining protrusion extending from and integrally formed with the body for receiving and retaining a tendon passing through the cellular walls and securing the cellular confinement system.

17. A fastener, according to claim 16, wherein the tendon-retaining protrusion secures the tendon at a fixed position when a tensile force is applied to the tendon.

18. A fastener, according to claim 16, wherein the thermoplastic body is formed of polyethylene.

19. A fastener, according to claim 16, wherein the fastener includes at least two tendon-retaining protrusions extending from and integrally formed with the body for receiving and retaining the tendon.

20. A fastener, according to claim 19, wherein the tendon-retaining protrusions are positioned substantially opposite one another.

21. For use with a three-dimensional cellular confinement system having a multitude of cells defined by cellular walls, a fastener comprising:

a molded thermoplastic body with a first portion, a second portion, and a shoulder;

the body having an opening extending from the first portion to the second portion and configured and arranged to receive a reinforcing bar, the opening tapered so as to be wider adjacent the second portion of the body than adjacent the first portion of the body;

the first portion configured and arranged to receive an external force of sufficient magnitude to securely hold the reinforcing bar in the opening; and a tendon-retaining protrusion extending from the thermoplastic body at the shoulder and configured for retaining a tendon securing the cellular confinement system.

22. A fastener, according to claim 21, wherein the first portion includes a drive surface for receiving the external force of sufficient magnitude to securely hold the retaining bar in the opening.

23. A fastener, according to claim 21, wherein the tendon-retaining protrusion secures a tendon when a tensile force is applied to the tendon.

24. A fastener, according to claim 21, wherein the body includes a first surface conforming to a shape of a cell wall of the cellular confinement system.

25. A fastener, according to claim 21, wherein the body includes a convex surface conformable to a concave cell wall and a concave surface conformable to a convex cell wall.

26. A fastener, according to claim 21, wherein the opening is tapered from 1 to 5 degrees.

27. A fastener, according to claim 21, wherein the opening is tapered from 2 to 3 degrees.

28. A fastener, according to claim 21, wherein the first portion includes a counterbore constructed and arranged to temporarily retain the fastener on the reinforcing rod.

29. A fastener, according to claim 21, wherein the body is formed of polyethylene.

30. A fastener, according to claim 21, wherein the fastener includes at least two tendon-retaining protrusions extending from and integrally formed with the body for receiving and retaining the tendon.

31. A fastener, according to claim 21, wherein the opening extends through the first and second portions.

32. A fastener, according to claim 21, wherein the tendon-retaining protrusion comprises an arm integrally molded to the body and positioned proximate the body such that a portion of a tendon may be retained in a space defined between the body and the arm.

33. A fastener, according to claim 21, wherein the tendon-retaining protrusion comprises an arm integrally molded to the body and positioned proximate the body such that a portion of a tendon may be retained in a space defined between the body and the arm; and a portion of the arm distal from the shoulder includes an extension projecting toward the body to further retain the tendon between the arm and the body.

34. A fastener, according to claim 33, wherein the extension includes an outer surface tapered to facilitate insertion of the tendon.

35. A fastener, according to claim 21, wherein the tendon-retaining protrusion comprises an arm integrally molded to the body and positioned proximate the body such that a portion of a tendon may be retained in a space defined between the body and the arm; and a portion of the arm between the shoulder and a distal end of the arm includes an extension projecting toward the body to further retain the tendon between the arm and the body.

36. A fastener, according to claim 21, wherein the tendon-retaining protrusion comprises an arm integrally molded to the body and positioned proximate the body such that a portion of a tendon may be retained in a space defined between the body and the arm; and a portion of the arm distal from the shoulder is tapered to facilitate insertion of the tendon.

37. A fastener, according to claim 21, wherein the tendon-retaining protrusion comprises an arm integrally molded to the body and positioned proximate the body such that a portion of a tendon may be retained in a space defined between the body and the arm; and the arm has a multilevel surface to facilitate insertion of the tendon.

38. For use with a three-dimensional cellular confinement system having a multitude of cells defined by cellular walls, a fastener comprising:

a body with a first portion and a second portion;

the first portion having an opening arranged to receive a reinforcing bar;

the second portion configured and arranged to receive an external force of sufficient magnitude to securely hold the reinforcing bar in the opening; and a cellular wall-retaining protrusion extending from and integrally formed with the body for receiving and retaining a cellular wall and securing the cellular confinement system.

39. A fastener, according to claim 38, wherein the second portion includes a drive surface to receive the external force of sufficient magnitude to securely hold the reinforcing bar in the opening.

40. A fastener, according to claim 38, wherein the fastener includes at least two cellular wall-retaining protrusions extending from, and integrally formed with, the body for securing the cellular wall.

41. A fastener, according to claim 38, wherein the opening in the first portion extends through the second portion.

42. A fastener, according to claim 41, wherein the opening is tapered from 1 to 5 degrees.

43. A fastener, according to claim 38, wherein the opening in the first portion includes a counterbore constructed and arranged to temporarily retain the fastener on the retaining bar.

44. A fastener, according to claim 38, wherein the fastener is formed of a molded thermoplastic material.

45. For use with a three-dimensional cellular confinement system for retaining a material over a substrate and within a multitude of cells divided by cell walls, a method of reinforcing the system comprising:

providing the three-dimensional cellular confinement system with a plurality of holes in the cell walls;

passing a flexible tendon through the holes in the cell walls;

providing a reinforcing bar with two ends and a molded tendon-retaining body secured proximate to one of the ends of the reinforcing bar;

driving the reinforcing bar into the substrate; and securing the flexible tendon to the molded tendon-retaining body, and wherein the step of providing a reinforcing bar includes providing a reinforcing bar having a molded tendon-retaining body including at least two tendon-retaining protrusions extending from and integrally formed with the body for retaining the tendon.

46. The method according to claim 45, wherein the step of securing results in the tendon being maintained at a fixed position when a tensile force is applied to the tendon.

47. The method according to claim 45, wherein the step of providing a reinforcing bar having a tendon-retaining body including at least two tendon-retaining portions includes providing tendon-retaining protrusions positioned substantially opposite one another.

48. For use with a three-dimensional cellular confinement system for retaining a material over a substrate and within a multitude of cells divided by cell walls, a method of reinforcing the system comprising:

providing the three-dimensional cellular confinement system with holes in respective ones of the cell walls;

passing a flexible tendon through the holes in the cell walls;

providing a molded tendon-retaining body within one of the cells, the body having a tendon-retaining protrusion extending from and integrally formed with the body for receiving and retaining the flexible tendon; and securing the flexible tendon to the molded tendon-retaining body so as to reinforce the cellular confinement system.

49. The method according to claim 48, wherein the step of providing a three-dimensional cellular confinement system includes installing the cellular confinement system on a substrate having an inclined surface.

50. The method according to claim 48, wherein the step of providing a body includes providing a body having at least two tendon-retaining protrusions.

51. The method according to claim 48, wherein the step of providing a body includes providing a body having a first surface conforming to a shape of a cell wall of the cellular confinement system.

52. The method according to claim 48, wherein the step of providing a body includes providing a body having a convex surface conformable to a concave cell wall, and a concave surface conformable to a convex cell wall.

53. The method according to claim 48, wherein the step of providing a body includes providing a body formed of polyethylene.

54. For use with a three-dimensional cellular confinement system for retaining a material over a substrate and within a multitude of cells divided by cell walls, a method of reinforcing the system comprising:

providing the three-dimensional cellular confinement system with a plurality of holes in the cell walls;

passing a flexible tendon through the holes in the cell walls;

providing a plurality of tendon retaining bodies, the tendon retaining bodies including a first portion having an opening extending into the first portion and configured and arranged to be driven onto a reinforcing bar so that the body is fixed adjacent to the end of the reinforcing bar, a second portion having a surface configured and arranged to receive a force of sufficient magnitude to drive the body onto the reinforcing bar, and a tendon-retaining protrusion extending from and integrally formed with the body for receiving a tendon;

providing a first molded tendon-retaining body within one of the cells, the body having a tendon-retaining protrusion extending from and integrally formed with the body for receiving and retaining the flexible tendon;

providing a reinforcing bar with two ends and a second molded tendon-retaining body secured adjacent to one of the ends of the reinforcing bar;

driving the reinforcing bar into the substrate; and securing the flexible tendon to the first and second molded tendon-retaining bodies.

* * * * *